US009702241B2

(12) United States Patent
Lozinsky et al.

(10) Patent No.: US 9,702,241 B2
(45) Date of Patent: Jul. 11, 2017

(54) AZIMUTHAL ORIENTATION DETERMINATION

(75) Inventors: Clint P. Lozinsky, Edmonton (CA); Jon Troy Gosney, Bellville, TX (US); Boguslaw Wiecek, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 956 days.

(21) Appl. No.: 13/386,591

(22) PCT Filed: Aug. 5, 2009

(86) PCT No.: PCT/US2009/052849
§ 371 (c)(1),
(2), (4) Date: May 7, 2012

(87) PCT Pub. No.: WO2011/016803
PCT Pub. Date: Feb. 10, 2011

(65) Prior Publication Data
US 2012/0205154 A1 Aug. 16, 2012

(51) Int. Cl.
*E21B 7/06* (2006.01)
*E21B 47/024* (2006.01)

(52) U.S. Cl.
CPC ..... *E21B 47/024* (2013.01); *E21B 7/067* (2013.01)

(58) Field of Classification Search
CPC ..... E21B 7/06; E21B 47/024; E21B 47/02
See application file for complete search history.

(56) References Cited

U.S. PATENT DOCUMENTS 4,866,680 A * 9/1989 Scherbatskoy ..... 367/83
5,875,859 A 3/1999 Ikeda et al.
6,192,748 B1 2/2001 Miller
6,234,259 B1 5/2001 Kuckes et al.
7,252,144 B2 8/2007 Estes et al.
7,432,500 B2 10/2008 Sale
2004/0173381 A1 9/2004 Moore et al.
2006/0028321 A1 * 2/2006 Kennedy et al. ..... 340/385.1
2007/0051512 A1 3/2007 Markel et al.
2008/0230273 A1 9/2008 Brooks
2008/0294344 A1 11/2008 Sugiura

FOREIGN PATENT DOCUMENTS

WO WO-2008004999 A1 1/2008
WO WO-2011016803 A1 2/2011

OTHER PUBLICATIONS

"International Application Serial No. PCT/US2009/52849, International Preliminary Report on Patentability Mailed Jan. 26, 2012", 13 pgs.
"International Application Serial No. PCT/US09/52849, Search Report mailed Sep. 23, 2009".
"International Application Serial No. PCT/US09/52849, Written Opinion mailed Jan. 1, 2009".

* cited by examiner

*Primary Examiner* — Catherine Loikith

(57) ABSTRACT

Apparatus, systems, and methods may operate to determine the rotating magnetic tool face associated with a rotating section of a drillstring, to determine angular displacement between the rotating section of the drillstring and a substantially fixed section housing the rotating the section, and to determine the magnetic tool face of the substantially fixed section by combining the rotating magnetic tool face and the angular displacement. Additional apparatus, systems, and methods may operate in a similar manner to determine tool face locations.

20 Claims, 6 Drawing Sheets

AZIMUTHAL ORIENTATION DETERMINATION

RELATED APPLICATIONS

This application is a U.S. National Stage Filing under 35 U.S.C. 371 from International Application No. PCT/US2009/052849, filed on Aug. 5, 2009, and published as WO 2011/016803 A1 on Feb. 10, 2011; which application and publication are incorporated herein by reference in their entirety.

BACKGROUND INFORMATION

During the course of petroleum recovery operations that include the use of steerable tools, it is often useful to determine the drilling direction with respect to magnetic North. Unfortunately, the orientation of the steering assembly, which is ideally fixed in relation to the borehole, can suffer from housing roll (e.g., slippage within the borehole) that operates to reduce the accuracy of tool face location mechanisms.

DETAILED DESCRIPTION

Figure 1:
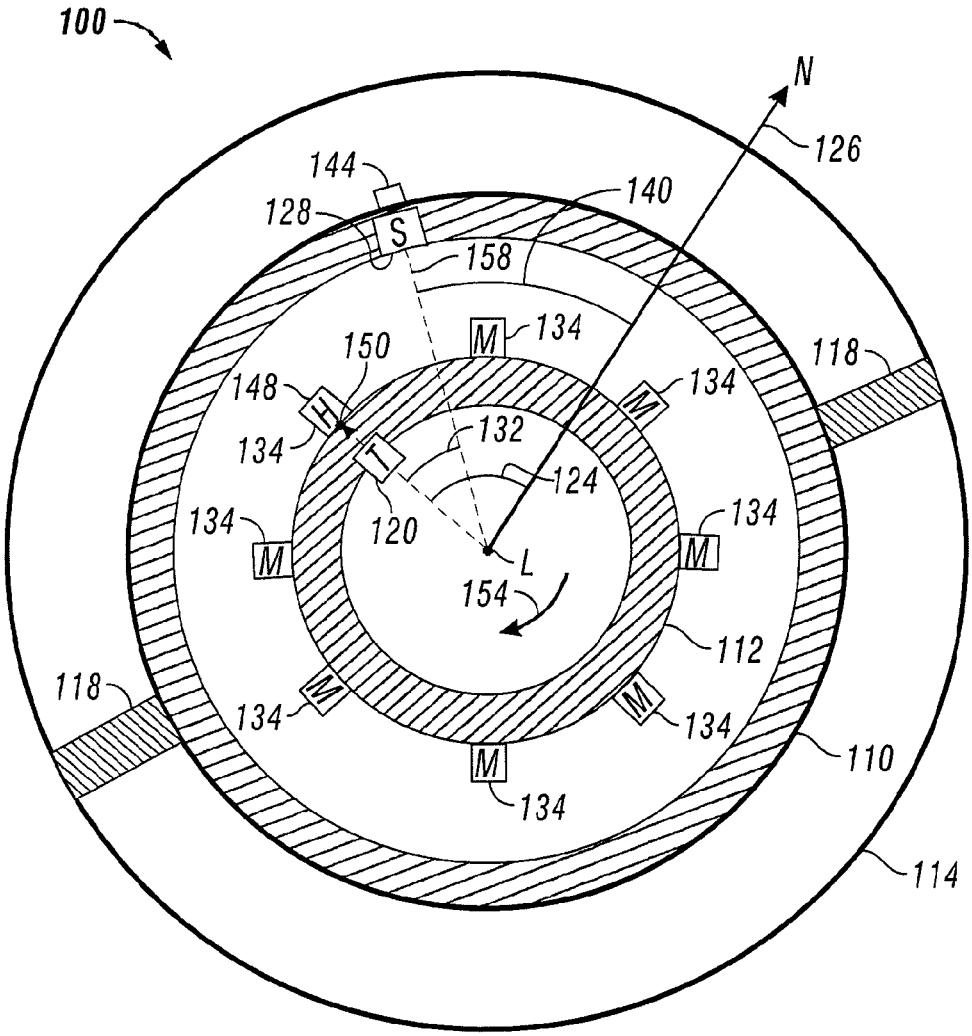
FIG. 1 illustrates a top, cut-away view of a tool face determination apparatus according to various embodiments of the invention.

Some rotary steerable tools do not have a reliable mechanism to determine the magnetic tool face for non-rotating sections, which can change due to "housing roll", which is the relatively slow change in azimuthal orientation of the steering mechanism (or some other substantially fixed section) during operations downhole. In some instances, housing roll may result in the non-rotating section undergoing a full-circle rotation more than once every minute. Using magnetometers in the non-rotating section of a drilling apparatus to determine the magnetic tool face of the non-rotating section is often not practical because the ferrous materials used in the non-rotating section can distort magnetic measurements. The magnetometer readings can also be affected by steering mechanism magnetic field interference.

Many of the embodiments described herein make use of two independent measurements to determine the magnetic tool face of the non-rotating section, sometimes taking the form of a housing for a portion of the rotating section, or drillstring. In this case, the magnetic tool face of the rotating section can be measured with respect to magnetic North using a magnetometer. The relative tool face of the non-rotating section is then measured with respect to the rotating section. Taken together, the relative measurement can be added to the rotating measurement to determine the magnetic tool face of the non-rotating section. In this way, the azimuthal orientation of a non-rotating (e.g., steering) section of a drillstring can be determined without using magnetometers in the non-rotating section itself.

Thus, in many embodiments, the rotating section makes use of magnetometers to determine the rotating magnetic tool face. A rotation sensing device is used to determine the angular displacement between the non-rotating section and the rotating section. The magnetic tool face of the non-rotating section is then determined by combining the magnetic tool face of the rotating section with the angular displacement of non-rotating section.

For the purposes of this document, a "non-rotating" or "substantially fixed" section is a section of pipe or some other physical component having an azimuthal orientation with respect to its longitudinal axis that is intended to remain relatively fixed, so that undesired housing roll or other rotation about the longitudinal axis occurs at a rate of less than about two revolution per minute when a co-existing rotating section is operating in a normal fashion (e.g., when the rotating section is running at a normal operating speed, such as approximately 100 revolutions per minute).

The "tool face" of a downhole tool or other component is the angle between a scribe line or other fixed reference point on the component and either the high side of a well-bore, or magnetic North (or true North if the magnetic declination is known).

The "magnetic tool face" is an angle formed between the component reference axis (e.g., a line that intersects the longitudinal axis of the component and a fixed reference point on the component) and magnetic North in a substantially horizontal plane, typically used when the well-bore is inclined less than approximately 8° from vertical.

FIG. 1 illustrates a top, cut-away view of a tool face determination apparatus 100 according to various embodiments of the invention. The apparatus 100 comprises a substantially fixed section 110 and a rotating section 112 that revolves about a longitudinal axis L. The substantially fixed section 110 is sometimes maintained in a relatively stable azimuthal orientation with respect to a well-bore 114 using one or more reference stabilizers 118.

The rotating section 112, as shown, may comprise a portion of a well-bore drillstring, and is coupled to one or more rotation position sensors 120, such as a magnetometer. The sensor 120 provides an indication of the rotating magnetic tool face 124 associated with magnetic North 126 and the rotating section 112.

The non-rotating or substantially fixed section 110 may be coupled to a well-bore 114, as shown, and is coupled to one or more angular position sensors 128 that are used to provide an indication of the angular displacement 132 between the rotating section 112 and a reference point 144 on the substantially fixed section 110. In most embodiments then, the angular position sensor 128 is installed in a location that is known with respect to the reference point 144.

The magnetic tool face 140 of the substantially fixed section 110 with respect to the reference point 144 (e.g., a scribe line on the substantially fixed section 110) can thus be determined by a combination of the rotating magnetic tool face 124 and the angular displacement 132. In this case, the combination can be made by subtracting the angular displacement 132 from the rotating magnetic tool face 124 to provide the magnetic tool face 140 of the substantially fixed section 110.

To determine the angular displacement 132, many different devices can be used. For example, as shown in FIG. 1, a set of magnets 134 can be attached to or embedded within the rotating section 112. One of the magnets 134 may comprise a "home" magnet 148, which is attached to the rotating section 112 at a location that is known with respect to a fixed reference point 150 on the rotating section 112. The home magnet 148 may be located in a different plane than the other magnets 134, or perhaps be fabricated to provide a different magnetic signature than the other magnets 134. In this way, when the rotating section 112 rotates in the clockwise direction 154 (in some embodiments, rotation occurs in the counter-clockwise direction), and the home magnet 148 passes by the angular position sensor 128, the sensor 128 will provide an indication of the angular displacement 132 between the fixed reference point 150 on the rotating section 112, and the reference point 144 on the substantially fixed section 110. Since each one of the number of magnets 134 operates to represent a discrete portion of a complete circle, the magnetic tool face 140 is binned into a number of sectors determined by the number of magnets 134 in some embodiments.

Thus, in the configuration shown in FIG. 1, when the home magnet 148 is in line with the sensor 128, the angular displacement is zero degrees, and the magnetic tool face 140 of the substantially fixed section 110 is the same as the rotating magnetic tool face 124—there is no offset. When the relative positions of the substantially fixed section 110 and the rotating section 112 are located as shown, the angular displacement 132 is negative, so the magnetic tool face 140 of the substantially fixed section 110 is provided by subtracting the magnitude of the angular displacement 132 from the rotating magnetic tool face 124. On the other hand, once the rotating section 112 continues to rotate in the direction 154 past the reference line 158, the angular displacement 132 becomes positive, so that the magnetic tool face 140 of the substantially fixed section 110 is provided by adding the magnitude of the angular displacement 132 to the rotating magnetic tool face 124.

For the sake of simplicity and clarity, it should be noted that all possible configurations of the magnets 134 and sensors 120, 128 have not been shown in FIG. 1. For example, in some embodiments the magnets 134 might be attached to the substantially fixed section 110, and one or more sensors 128 might be mounted to the rotating section 112. Thus, the various embodiments described herein are not to be so limited.

Figure 2:
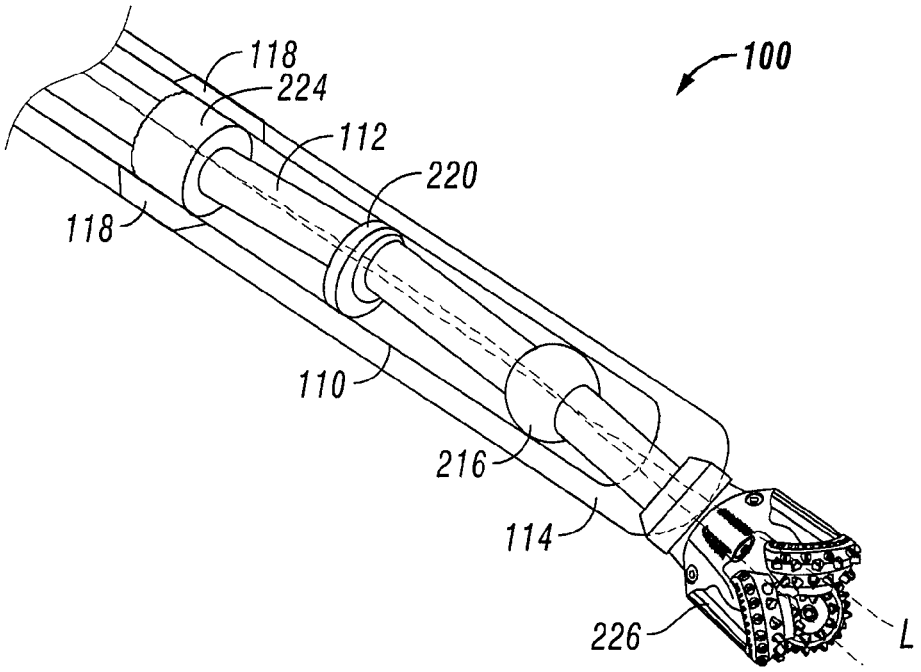
FIG. 2 illustrates a perspective view of a tool face determination apparatus according to various embodiments of the invention.

FIG. 2 illustrates a perspective view of a tool face determination apparatus 100 according to various embodiments of the invention. Here the apparatus 100 is shown forming part of a down-hole drilling apparatus, with portions of a directional drilling control system. The drill bit 226 can be steered away from the longitudinal axis L using a combination of the focal bearing 216, eccentric rings 220, and the cantilever bearing 224. The magnetic tool face of the substantially fixed section 110 can be determined as the rotating section 112 turns, using the mechanism described with respect to FIG. 1.

Figure 3:
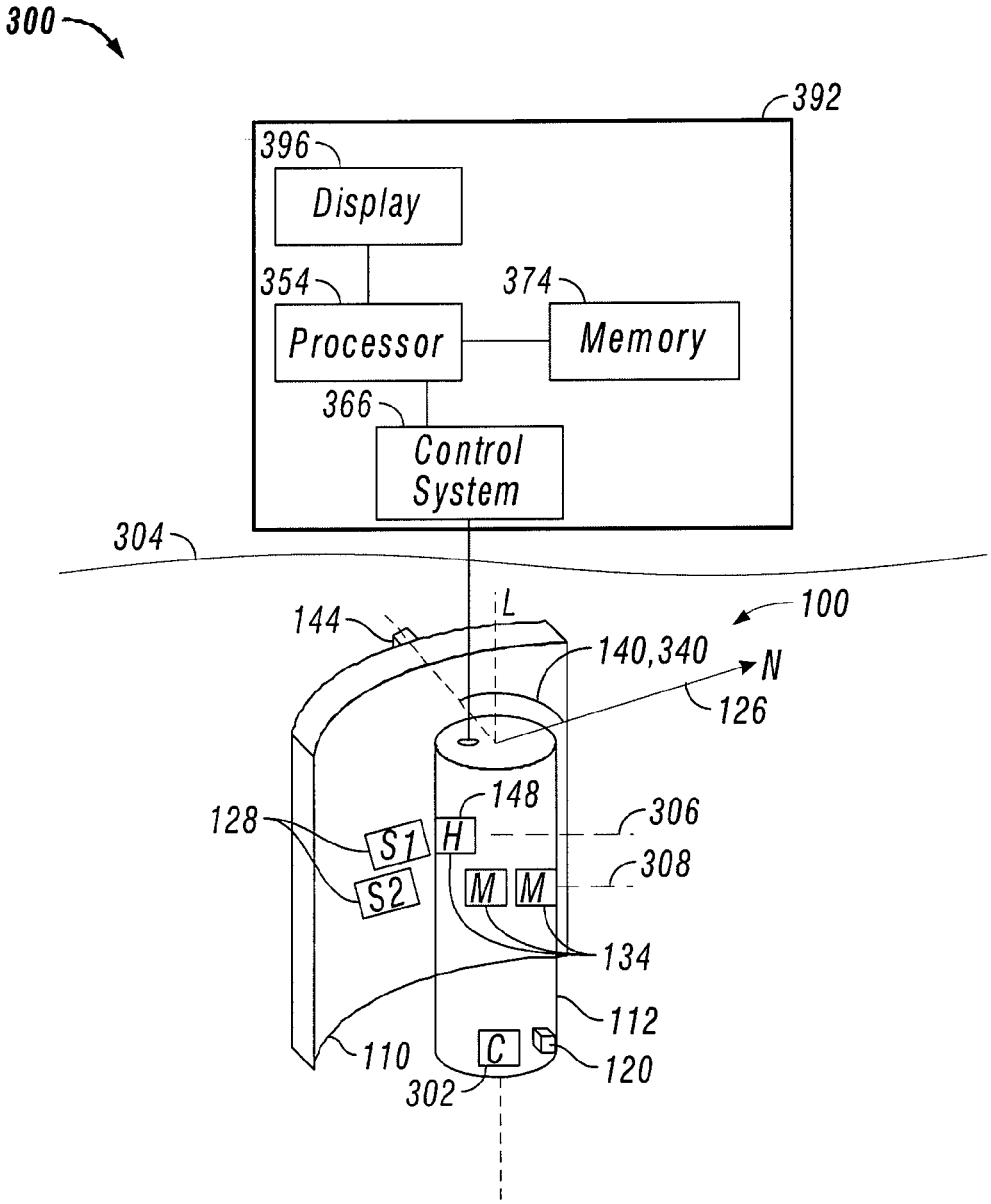
FIG. 3 illustrates a tool face determination system according to various embodiments of the invention.

FIG. 3 illustrates a tool face determination system 300 according to various embodiments of the invention. To provide a mechanism for determining the magnetic tool face of the substantially fixed section 110, various embodiments can make use of one or more sensors 128 that detect the proximity of one or more magnets 134, 148.

As shown in FIG. 3, the home magnet 148 is one plane 306, and the other magnets 134 are in another plane 308, each of the planes 306, 308 being substantially parallel to each other and/or substantially perpendicular to the longitudinal axis L. This configuration may be useful in determining the location of the home magnet 148 in relation to the sensors 128 (e.g., sensor S1), as opposed to the location of any of the other magnets 134 (e.g., with respect to sensor S2) without differentiating between the signature of the home magnet 148 and the signatures of the other magnets 134. In some embodiments, a compass 302 may be coupled to the substantially fixed section 110 to provide an initial, calibrated determination of the magnetic tool face 140 of the substantially stationary section 110.

Referring now to FIGS. 1 and 2, it can be seen that many embodiments can be realized. For example, in some embodiments, an apparatus comprises a substantially fixed section 110 and a rotating section 112. One or more sensors 120 (e.g., magnetometers or a compass) can be used to measure the rotating magnetic tool face 124, which measurement is independent of that made by the sensors 128, perhaps in conjunction with multiple magnets 134 to determine the angular displacement 132 of the substantially fixed section 110 with respect to the rotating section 112. In some embodiments, the angular displacement 132 may take the form of a relative bin count, or the number of magnets 134 that have passed the sensor 128 after the home magnet 148 has been detected. Ultimately, the tool face 140 of the substantially fixed section 110 can be determined using a combination of the rotating magnetic toolface 124 and the angular displacement 132.

Thus, in some embodiments, an apparatus 100 comprises a rotating section 112 to couple to a well-bore drillstring and to one or more rotation position sensors 120 to provide an indication of a rotating magnetic tool face 124 associated with the rotating section 112. The apparatus 100 may also comprise a substantially fixed section 110 to couple to a well-bore 114 and one or more angular position sensors 128 to provide an indication of angular displacement 132 between the rotating section 112 and the substantially fixed section 110.

A variety of devices can be used to sense and indicate the magnetic tool face 124 of the rotating section 112. Thus, the rotation position sensor 120 may comprise one or more magnetometers, or a compass, among others.

Several different types of sensors can also be used to sense and indicate the degree of angular displacement 132 between the rotating section 112 and the substantially fixed section 110. Thus, the angular position sensor 128 may comprise one or more of a hall-effect sensor, a rotary variable differential transformer (RVDT), a potentiometer, or an encoder, among others.

The rotating section 112 may have one or more magnets 134 attached to it, with at least one of the magnets comprising a home magnet 148 having a known location on the rotating section 112, such as being located on the scribe line or some other reference point 150 of the rotating section 112. Thus, the rotating section 112 may further comprise at least one home magnet 148 located at a known offset from a fixed reference point 150 on the rotating section 112.

The number of magnets 134 included in the apparatus 100 may be any number, such as 8, 16, 32, or more. The number may be even or odd. The magnets 134 may be used to separate the periphery of the rotating section 112 into portions, or bins. Thus, the rotating section 112 may further comprise a plurality of bin magnets 134 attached at known locations (e.g., spaced apart and approximately equidistant from each other) to the periphery of the rotating section 112. In some embodiments, the home magnet 148 is included as one of the bin magnets 134.

The home magnet 148 and the bin magnets 134 may or may not be located on separate planes. Thus, a first plane 306 including some of the bin magnets 134 may be different from a second plane 308 substantially parallel to the first plane 306, the second plane 308 including a home magnet 148 located at a known offset from a fixed reference point 150 on the rotating section.

All of the magnets 134 may be located in a single plane in some embodiments. Thus, it may be useful to construct the magnets 134 so that one or more of the bin magnets 134 has a different magnetic signature than the others. For example, one bin magnet 134 (e.g., the home magnet 148) may comprise a dual-magnet assembly that gives a stronger field, or an opposite polarity, or provide a multi-field indication with respect to the rest of the single bin magnets 134 (e.g., providing proximate fluctuations in the indicated magnetic field strength that occur more rapidly than would be expected according to the distance between the bin magnets, as the home magnet 148 passes by the sensor 128). In some embodiments, the home magnet 148 may have a magnetic polarity that is opposite to that of the bin magnets 134. Thus, in some embodiments, at least one of the bin magnets 134 has a different magnetic signature than a remaining number of the bin magnets 134.

The substantially fixed section 110 may form a housing for the rotating section 112. Thus, in some embodiments, the substantially fixed section 110 at least partially encloses the rotating section 112.

The sections 110, 112 may each comprise iron, alloys of iron, and steel, among other materials. Thus, the rotating section 112 and the substantially fixed section 110 may comprise a ferrous material, or a non-ferrous material.

A survey tool can be used for an alternate or complementary measurement of the magnetic tool face of the substantially fixed section (e.g., a steering section). For example, an electronic compass 302, which may be separately calibrated (e.g., by characterizing or scaling the output of the compass 302 according to the earth's local magnetic and gravitational fields, depending on the inclination of the apparatus 100), can be used to provide a survey-quality determination of the substantially fixed section 110 magnetic tool face 140. Therefore, in some embodiments, the apparatus 100 may comprise an electronic compass 302 to provide a non-rotating magnetic tool face 340 associated with the substantially fixed section 110.

In some embodiments, it can be seen that a system 300 may comprise one or more apparatus 100, as well as a directional drilling control system 366 to direct the activity of a bit 226. The directional drilling control system 366 may be similar to or identical to the Sperry Drilling Services Geo-Pilot®, EZ-Pilot®, and V-Pilot® systems, or the Schlumberger Oilfield Services PowerDrive systems, well known to those of ordinary skill in the art. Thus, the directional drilling control system 366 may comprise a rotary steerable drilling control system.

A processor 354 may be used to execute instructions stored in a memory 374 to accomplish any of the methods or processing described herein. A display 396, perhaps forming part of a surface workstation 392 in the system 300 may be used to display the magnetic toolface 140 of the substantially fixed section 110, the angular displacement 132, the non-rotating magnetic tool face 340, housing roll, and/or other information. The system 300 may comprise a downhole tool that includes any one or more components of the system 300.

Figure 4:
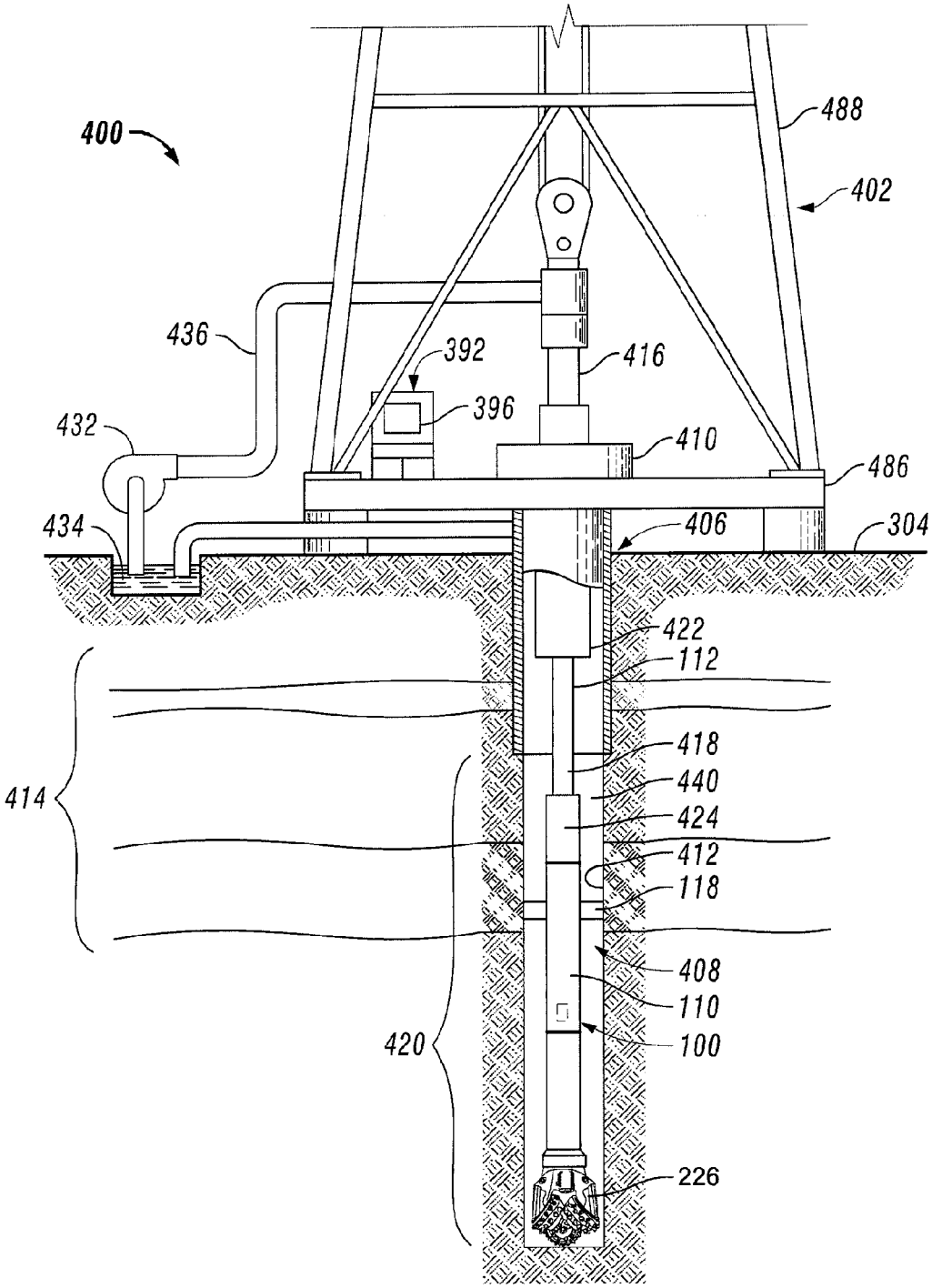
FIG. 4 illustrates another tool face determination system according to various embodiments of the invention.

FIG. 4 illustrates another tool face determination system 400 according to various embodiments of the invention. The system 400 may comprise more than one of the apparatus 100, as well as one or more systems 300. Thus, the apparatus 100 and system 300 as described above and shown in FIGS. 1-3 may form portions of a down hole tool 424 as part of a downhole drilling operation.

Turning now to FIG. 4, it can be seen how a system 400 may also form a portion of a drilling rig 402 located at the surface 304 of a well 406. The drilling rig 402, comprising a drilling platform 486 may be equipped with a derrick 488 that supports a drill string 408 lowered through a rotary table 410 into a wellbore or borehole 412.

Thus, the drill string 408 may operate to penetrate a rotary table 410 for drilling the borehole 412 through subsurface formations 414. The drill string 408 may include a Kelly 416, drill pipe 418, and a bottom-hole assembly (BHA) 420, perhaps located at the lower portion of the drill pipe 418. The drill string 408 may include wired and unwired drill pipe, as well as wired and unwired coiled tubing, including segmented drilling pipe, casing, and coiled tubing.

The BHA 420 may include drill collars 422, a down hole tool 424, and a drill bit 226. The drill bit 226 may operate to create a borehole 412 by penetrating the surface 304 and subsurface formations 414. The down hole tool 424 may comprise any of a number of different types of tools including measurement while drilling (MWD) tools, logging while drilling (LWD) tools, and others.

During drilling operations, the drill string 408 (perhaps including the Kelly 416, the drill pipe 418, and the BHA 420) may be rotated by the rotary table 410. In addition to, or alternatively, the bottom hole assembly 420 may also be rotated by a top drive or a motor (e.g., a mud motor) that is located down hole. The drill collars 422 may be used to add weight to the drill bit 226. The drill collars 422 also may stiffen the BHA 420 to allow the BHA 420 to transfer the added weight to the drill bit 226, and in turn, assist the drill bit 226 in penetrating the surface 304 and subsurface formations 414.

During drilling operations, a mud pump 432 may pump drilling fluid (sometimes known by those of ordinary skill in the art as "drilling mud" or simply "mud") from a mud pit 434 through a hose 436 into the drill pipe 418 and down to the drill bit 226. The drilling fluid can flow out from the drill bit 226 and be returned to the surface 304 through an annular area 440 between the drill pipe 418 and the sides of the borehole 412. The drilling fluid may then be returned to the mud pit 434, where such fluid is filtered. In some embodiments, the drilling fluid can be used to cool the drill bit 226, as well as to provide lubrication for the drill bit 226 during drilling operations. Additionally, the drilling fluid may be used to remove subsurface formation 414 cuttings created by operating the drill bit 226.

Thus, referring now to FIGS. 1-4, it may be seen that in some embodiments, the system 400 may include a drill collar 422, a drill string 408, and/or a down hole tool 424 to which one or more apparatus 100 are attached. The down hole tool 424 may comprise an LWD tool, or an MWD tool. The drill string 408 may be mechanically coupled to the down hole tool 424. Thus, additional embodiments may be realized.

For example, a system 400 may comprise a well-bore drillstring 408 coupled to a rotating section (e.g., drill pipe 418) and a rotation position sensor 120 to provide an indication of a rotating magnetic tool face associated with the rotating section. The system 400 may also comprise a directional drilling control system 366 (e.g., perhaps forming part of workstation 392) coupled to a substantially fixed section 110 and an angular position sensor 128 to provide an indication of angular displacement between the rotating section and the substantially fixed section 110.

An electronic compass 302, which may be separately calibrated, can be used to provide a survey-quality location of the substantially fixed section 110 (e.g., housing) magnetic tool face 140. Thus, in some embodiments, the system 400 comprises an electronic compass 302 to provide a non-rotating magnetic tool face 340 associated with the substantially fixed section 110.

A display 396 may be coupled to the system 400 and used to display information derived from the rotating magnetic tool face 124 and the angular displacement 132, such as the housing magnetic tool face 140, housing roll, etc. Thus, the system 400 may comprise a display 396 to display information derived from the rotating magnetic tool face 124 and the angular displacement 132.

The amount of slip or other unwanted movement (e.g., housing roll) associated with the substantially fixed section can be determined and tracked. Housing roll can be calculated as the current magnetic tool face 140 of the substantially fixed section 110, less the previous magnetic tool face 140 of the substantially fixed section 110, with the difference being divided by the time between the measurement of each value (e.g., (current-previous)/time). Thus, the system 400 may comprise a processor 354 to determine an amount of housing roll associated with the substantially fixed section 110.

As noted previously, the rotation position sensor 120 may comprise one or more magnetometers to provide the indication of the rotating magnetic tool face 124. Similarly, the angular position sensor 128 may include one or more hall-effect devices and at least one magnet 134 to provide an indication of angular displacement 132.

The apparatus 100; sections 110, 112; well-bores 114, 412; stabilizers 118; sensors 120, 128, S1, S2; tool face 124; magnetic North 126; displacement 132; magnets 134, 148; reference points 144, 150; direction 154; focal bearing 216; eccentric rings 220; cantilever bearing 224; drill bit 226; systems 300, 400; compass 302; surface 304; planes 306, 308; processor 354; control system 366; memory 374; workstation 392; display 396; drilling rig 402; well 406; drill string 408; rotary table 410; subsurface formations 414; Kelly 416; drill pipe 418; BHA 420; drill collars 422; mud pump 432; mud pit 434; hose 436; area 440; drilling platform 486; derrick 488; and longitudinal axis L may all be characterized as "modules" herein. Such modules may include hardware circuitry, one or more processors and/or memory circuits, software program modules and objects, and firmware, and combinations thereof, as desired by the architect of the apparatus 100 and systems 300, 400 and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for borehole drilling and logging operations, and thus, various embodiments are not to be so limited. The illustrations and descriptions of apparatus 100 and systems 300, 400 are intended to provide a general understanding of the structure of various embodiments, and they are not intended to serve as a complete description of all the elements and features of apparatus and systems that might make use of the structures described herein.

Applications that may include the novel apparatus and systems of various embodiments comprise process measurement instruments, personal computers, workstations, and vehicles, among others. Some embodiments include a number of methods.

Figure 5:
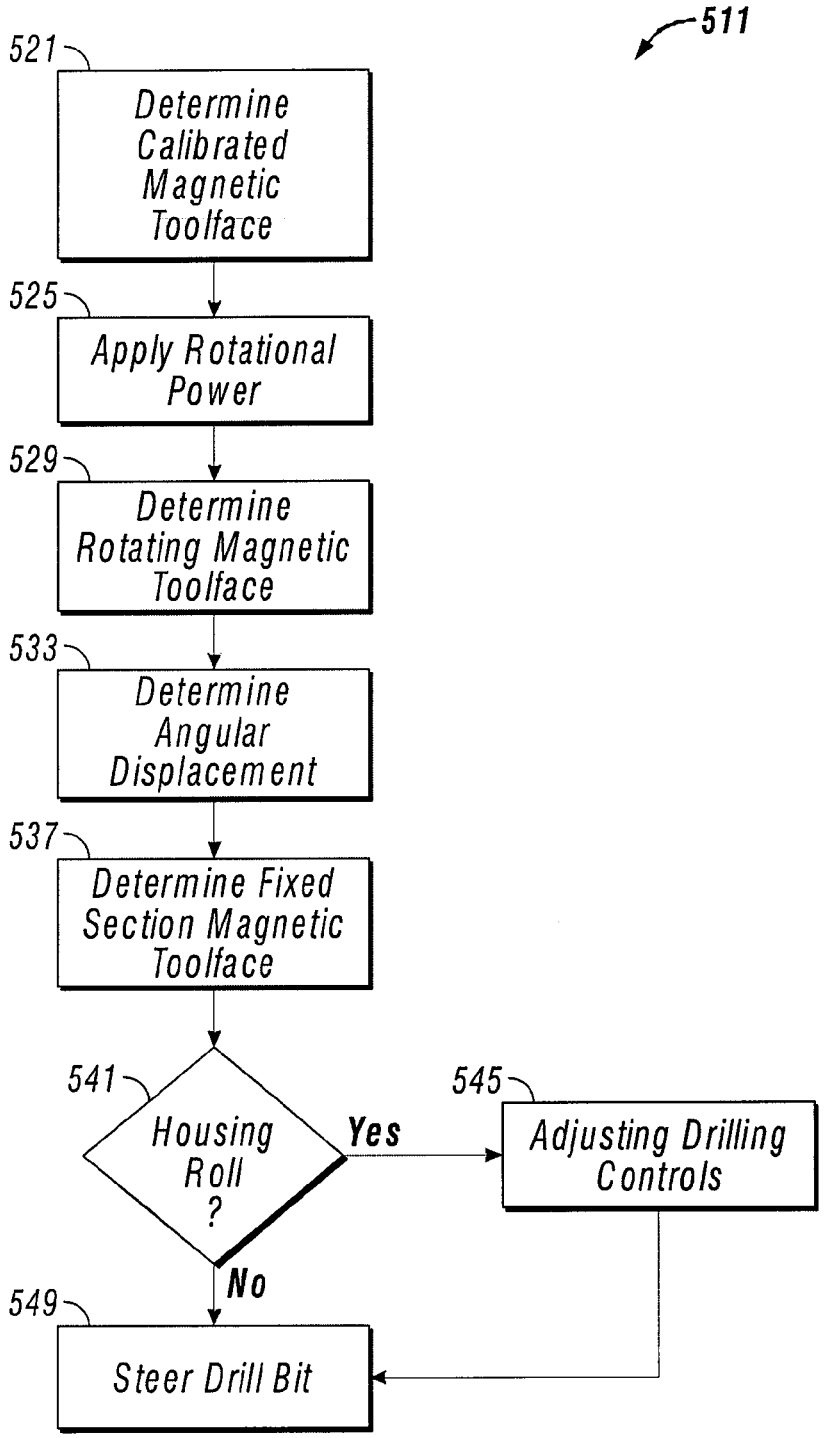
FIG. 5 is a flow diagram illustrating several methods according to various embodiments of the invention.

For example, FIG. 5 is a flow chart illustrating several methods 511 according to various embodiments of the invention. To begin, the magnetic tool face of the substantially fixed section can be determined using an electronic compass, which may have been previously calibrated, when the rotating section is immobile. Thus, a method 511 may begin at block 521 with determining a calibrated magnetic tool face of the substantially fixed section using an electronic compass, while the rotating section remains stationary. The method 511 may continue on to block 525 with the application of power to the rotating section, causing the rotating section to begin rotation.

The method 511 may include, at block 529, determining the rotating magnetic tool face associated with a rotating section of a drillstring. The method 511 may continue on to block 533 with determining the angular displacement between the rotating section of the drillstring and a substantially fixed section (that houses the rotating the section in some embodiments). The substantially fixed section may be coupled to the bore-hole, perhaps using stabilizers or other apparatus.

The angular displacement may be derived from a series of discrete indications, such as magnets passing by a hall-effect sensor, or the pulses of an optical encoder. The resulting discrete indications can be counted, relative to receiving a home or reference indication, to determine the total amount of angular displacement. The angular displacement may be binned according to the number of rotational indications received after the home or reference indication is received (e.g., from a home magnet passing by a hall-effect sensor). Thus, the activity at block 533 may comprise receiving discrete indications of the angular displacement to determine an approximate total amount of the angular displacement.

The method 511 may continue on to block 537 with determining the magnetic tool face of the substantially fixed section by combining the rotating magnetic tool face and the angular displacement.

The magnetic tool face of the substantially fixed section can be monitored to determine whether an undesired amount of housing roll exists at block 541. Thus, the activity at block 537 and 541 may comprise monitoring housing roll associated with the substantially fixed section by periodically receiving the magnetic tool face of the substantially fixed section. If the amount of housing roll is greater than some pre-selected threshold magnitude, then the method may continue on block 545 with adjusting drilling controls, including steering controls, to counter the effect of the roll, as determined at block 537 and expressed in terms of a change in magnetic tool face for the substantially fixed section.

In this way, the magnetic tool face of the substantially fixed section can be used to steer a drill bit, for improved directional steering capability, since housing roll can be monitored, and adjustments made. Thus, the method 511 may include, at block 549, steering a drill bit coupled to the drillstring according to the magnetic tool face of the substantially fixed section. In some embodiments, the activity at block 549 may include steering a drill bit coupled to the drillstring according to the rotating magnetic tool face.

It should be noted that the methods described herein do not have to be executed in the order described. Moreover, various activities described with respect to the methods identified herein can be executed in iterative, serial, or parallel fashion. Information, including parameters, commands, operands, and other data, can be sent and received, and perhaps stored using a variety of tangible media, such as a memory. Any of the activities in these methods may be performed, in part, by a digital electronic system (e.g., a digital computer), an analog electronic system (e.g., an analog control system), or some combination of the two.

Figure 6:
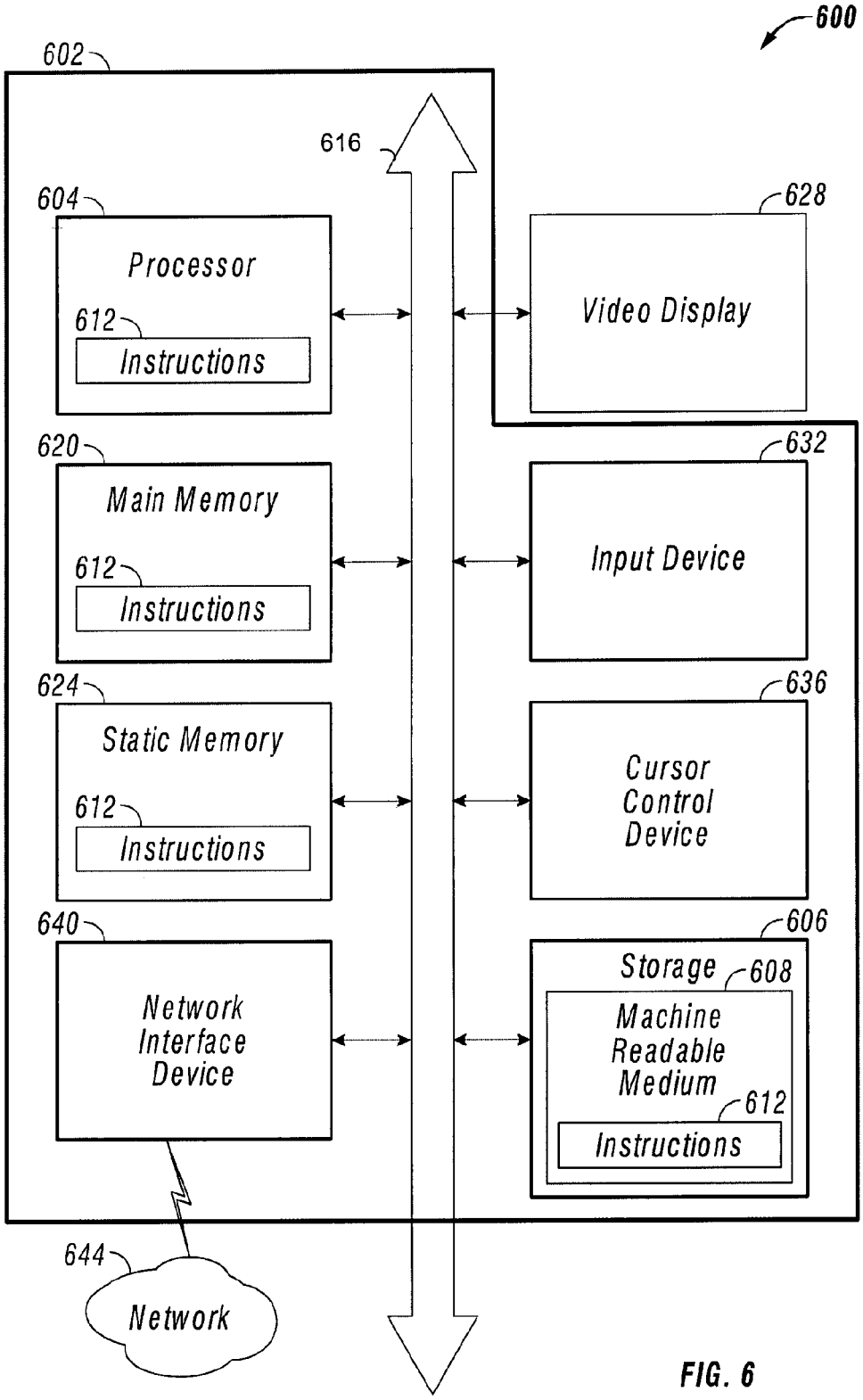
FIG. 6 is a block diagram of an article according to various embodiments of the invention.

FIG. 6 is a block diagram of an article 600 of manufacture, including a specific machine 602, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. The programs may be structured in an object-orientated format using an object-oriented language such as Java or C++. Alternatively, the programs can be structured in a procedure-orientated format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 600 of manufacture, such as a computer, a memory system, a magnetic or optical disk, some other storage device, and/or any type of electronic device or system may include one or more processors 604 coupled to a machine-readable medium 608 such as a memory (e.g., removable storage media, as well as any memory including an electrical, optical, or electromagnetic conductor comprising tangible media) having instructions 612 stored thereon (e.g., computer program instructions), which when executed by the one or more processors 604 result in the machine 602 performing any of the actions described with respect to the methods above.

The machine 602 may take the form of a specific computer system having a processor 604 coupled to a number of components directly, and/or using a bus 616. Thus, the machine 602 may be similar to or identical to the workstation 392 shown in FIGS. 3 and 4.

Turning now to FIG. 6, it can be seen that the components of the machine 602 may include main memory 620, static or non-volatile memory 624, and mass storage 606. Other components coupled to the processor 604 may include an input device 632, such as a keyboard, or a cursor control device 636, such as a mouse. An output device 628, such as a video display, may be located apart from the machine 602 (as shown), or made as an integral part of the machine 602.

A network interface device 640 to couple the processor 604 and other components to a network 644 may also be coupled to the bus 616. The instructions 612 may be transmitted or received over the network 644 via the network interface device 640 utilizing any one of a number of well-known transfer protocols (e.g., HyperText Transfer Protocol). Any of these elements coupled to the bus 616 may be absent, present singly, or present in plural numbers, depending on the specific embodiment to be realized.

The processor 604, the memories 620, 624, and the storage device 606 may each include instructions 612 which, when executed, cause the machine 602 to perform any one or more of the methods described herein. In some embodiments, the machine 602 operates as a standalone device or may be connected (e.g., networked) to other machines. In a networked environment, the machine 602 may operate in the capacity of a server or a client machine in server-client network environment, or as a peer machine in a peer-to-peer (or distributed) network environment.

The machine 602 may comprise a personal computer (PC), a workstation, a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 602 is illustrated, the term "machine" shall also be taken to include any collection of machines that individually or jointly execute a set (or multiple sets) of instructions to perform any one or more of the methodologies discussed herein.

While the machine-readable medium 608 is shown as a single medium, the term "machine-readable medium" should be taken to include a single medium or multiple media (e.g., a centralized or distributed database, and/or associated caches and servers, and or a variety of storage media, such as the registers of the processor 604, memories 620, 624, and the storage device 606 that store the one or more sets of instructions 612. The term "machine-readable medium" shall also be taken to include any medium that is capable of storing, encoding or carrying a set of instructions for execution by the machine and that cause the machine 602 to perform any one or more of the methodologies of the present invention, or that is capable of storing, encoding or carrying data structures utilized by or associated with such a set of instructions. The terms "machine-readable medium" or "computer-readable medium" shall accordingly be taken to include tangible media, such as solid-state memories and optical and magnetic media.

Various embodiments may be implemented as a standalone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

While many embodiments have been described with respect to housing roll detection and correction, it should be noted that other applications are possible as well. For example, some embodiments can be used to provide vertical kickoff, steering the well direction even when gravity tool face is not available. Many embodiments permit the azimuth of the substantially fixed section to be measured and corrected while rotation occurs, without having to stop the survey. Thus, azimuthal steering can be accomplished while rotation occurs. Azimuthal cruise control can also be provided in some embodiments, where the drilling tool is programmed to maintain a substantially constant azimuth without operator intervention. This feature can be used separately, or added to tools that currently provide inclination cruise control.

Thus, implementing the apparatus, systems, and methods of various embodiments may provide a new way to determine whether housing roll has occurred, and if so, to what degree. In addition, the magnetic tool face of the substantially fixed section (which may comprise a steering mechanism) can be determined to correct for housing roll when gravity tool face is not available. Finally, azimuthal steering and azimuthal cruise control can be implemented for additional flexibility. Improved drilling efficiency, and lower drilling costs, may result.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a rotating section to couple to a well-bore drillstring and a rotation position sensor to provide an indication of a rotating magnetic tool face associated with the rotating section, the rotation position sensor comprising multiple magnets circumferentially spaced apart from each other on the rotating section, with at least one of the multiple magnets positioned in a first plane on the rotating section, and a remainder of the multiple magnets positioned in a second plane on the rotating section, wherein the planes are parallel to each other and spaced apart along a longitudinal axis of the rotating section;

a substantially fixed section to couple to a well-bore and an angular position sensor to provide an indication of rotary angular displacement between the rotating section and the substantially fixed section, the substantially fixed section to couple to the well-bore drillstring or arranged as a part of the well-bore drillstring; and a processor to determine a magnetic tool face of the substantially fixed section by combining the rotating magnetic tool face and the rotary angular displacement.

2. The apparatus of claim 1, wherein the rotation position sensor comprises:

at least one magnetometer.

3. The apparatus of claim 1, wherein the angular position sensor comprises:

at least one of a hall-effect sensor, a rotary variable differential transformer, a potentiometer, or an encoder.

4. The apparatus of claim 1, wherein the rotating section further comprises:

at least one home magnet located at a known offset from a fixed reference point on the rotating section.

5. The apparatus of claim 1, wherein the rotating section further comprises:

a plurality of bin magnets, at least some of which are attached to a periphery of the rotating section.

6. The apparatus of claim 5, wherein a first plane including some of the bin magnets is not the same as a second plane substantially parallel to the first plane, the second plane including a home magnet located at a known offset from a fixed reference point on the rotating section.

7. The apparatus of claim 5, wherein at least one of the bin magnets has a different magnetic signature than a remaining number of the bin magnets.

8. The apparatus of claim 1, wherein the substantially fixed section partially encloses the rotating section.

9. The apparatus of claim 1, wherein the rotating section and the substantially fixed section comprise one of a ferrous material or a non-ferrous material.

10. A system, comprising:

a well-bore drillstring coupled to a rotating section and a rotation position sensor to provide an indication of a rotating magnetic tool face associated with the rotating section, the rotation position sensor comprising multiple magnets circumferentially spaced apart from each other on the rotating section, with at least one of the multiple magnets positioned in a first plane on the rotating section, and a remainder of the multiple magnets positioned in a second plane on the rotating section, wherein the planes are parallel to each other and spaced apart along a longitudinal axis of the rotating section; and a directional drilling control system coupled to the drillstring and an angular position sensor to provide an indication of rotary angular displacement between the rotating section and a substantially fixed section, the substantially fixed section coupled to the well-bore drillstring or arranged as a part of the well-bore drillstring; and a processor to determine a magnetic tool face of the substantially fixed section by combining the rotating magnetic tool face and the rotary angular displacement.

11. The system of claim 10, further comprising:

an electronic compass to provide a non-rotating magnetic tool face associated with the substantially fixed section.

12. The system of claim 10, further comprising:

a display to display information derived from the rotating magnetic tool face and the rotary angular displacement.

13. The system of claim 10, further comprising:

the processor to determine an amount of housing roll associated with the substantially fixed section.

14. The system of claim 10, wherein the directional drilling control system comprises a rotary steerable drilling control system.

15. The system of claim 10, further comprising:

the rotation position sensor including at least one magnetometer to provide the indication of the rotating magnetic tool face; and the angular position sensor including a hall-effect device and at least one magnet to provide the indication of rotary angular displacement.

16. A method, comprising:

determining a rotating magnetic tool face associated with a rotating section of a drillstring using a rotation position sensor coupled to the rotating section, the rotation position sensor comprising multiple magnets circumferentially spaced apart from each other on the rotating section, with at least one of the multiple magnets positioned in a first plane on the rotating section, and a remainder of the multiple magnets positioned in a second plane on the rotating section, wherein the planes are parallel to each other and spaced apart along a longitudinal axis of the rotating section;

determining rotary angular displacement between the rotating section of the drillstring and a substantially fixed section housing the rotating section using an angular position sensor coupled to the substantially fixed section, the substantially fixed section coupled to a bore-hole, the substantially fixed section coupled to the drillstring or arranged as a part of the drillstring; and determining a magnetic tool face of the substantially fixed section by combining the rotating magnetic tool face and the rotary angular displacement.

17. The method of claim 16, further comprising:

determining a calibrated magnetic tool face of the substantially fixed section using an electronic compass, when the rotating section remains stationary.

18. The method of claim 16, further comprising:

steering a drill bit coupled to the drillstring according to the magnetic tool face of the substantially fixed section or according to the rotating magnetic tool face.

19. The method of claim 16, further comprising:

monitoring housing roll associated with the substantially fixed section by periodically receiving the magnetic tool face of the substantially fixed section.

20. The method of claim 16, further comprising:

receiving discrete indications of the angular displacement to determine an approximate total amount of the rotary angular displacement.

* * * * *